US007786828B2

(12) United States Patent
Rosenberg et al.

(10) Patent No.: US 7,786,828 B2
(45) Date of Patent: Aug. 31, 2010

(54) WAVEGUIDE BANDSTOP FILTER

(75) Inventors: Uwe Rosenberg, Backnang (DE); Smain Amari, Kingston (CA); Michael Knipp, Aspach (DE)

(73) Assignee: Ericsson AB, Stockholm (SE)

( * ) Notice: Subject to any disclaimer, the term of this patent is extended or adjusted under 35 U.S.C. 154(b) by 134 days.

(21) Appl. No.: 12/088,791

(22) PCT Filed: Aug. 29, 2006

(86) PCT No.: PCT/EP2006/065774

§ 371 (c)(1),
(2), (4) Date: Jun. 5, 2008

(87) PCT Pub. No.: WO2007/039360

PCT Pub. Date: Apr. 12, 2007

(65) Prior Publication Data

US 2009/0153272 A1 Jun. 18, 2009

(30) Foreign Application Priority Data

Sep. 30, 2005 (DE) ..... 10 2005 047 336

(51) Int. Cl.
*H01P 1/207* (2006.01)
*H01P 1/208* (2006.01)

(52) U.S. Cl. ..... 333/208; 333/212

(58) Field of Classification Search ..... 333/208, 333/209, 210, 212, 135, 157, 211
See application file for complete search history.

(56) References Cited

U.S. PATENT DOCUMENTS 3,215,955 A * 11/1965 Thomas et al. ..... 333/102

FOREIGN PATENT DOCUMENTS

| | | |
|---|---|---|
| EP | 1 538 692 | 6/2005 |
| GB | 1281564 | 7/1972 |
| GB | 2 359 197 | 8/2001 |
| JP | 63 308401 | 12/1988 |
| JP | 02 159801 | 6/1990 |
| JP | 02 235405 | 9/1990 |
| JP | 07 015211 | 1/1995 |

OTHER PUBLICATIONS

Rhodes, J. David. "Waveguide Bandstop Elliptic Function Filters." IEEE Transactions on Microwave Theory and Techniques, vol. MMT-20, No. 11, Nov. 1972, pp. 715-718.

Patzelt, H. "Blenden endlicher dicke in Rechteckhohlleitern and langsgekoppelte Hohlleiterfilter/Irises with Rectangular Apertures of Any Thickness in Rectangular Waveguides and Direct Coupled Half Wave Filters." In: Frequenz 33, 1979, pp. 94-101.

Katzier, H. "Filtergenschaften von Rechteckhohlleitern mit quaderformigen dielektrischen Resonatoren/Filter Properties of Rectangular Waveguides with Rectangular Dielectric Resonator Inserts." In: Frequenz 41, 1987, pp. 115-120.

* cited by examiner

*Primary Examiner*—Dean O Takaoka
(74) *Attorney, Agent, or Firm*—Coats & Bennett, P.L.L.C.

(57) ABSTRACT

In a bandstop filter having an input port (2; 3), an output port (3; 2) and a waveguide (1, 1') connecting the two ports, at least one resonator body (4, 5; 4' 5) is located in the waveguide (1, 1'), which resonator body has resonance frequency above the limit frequency of the waveguide (1; 1').

12 Claims, 4 Drawing Sheets

WAVEGUIDE BANDSTOP FILTER

The present invention relates to a bandstop filter having an input port, an output port and a hollow waveguide interconnecting the two. Such a bandstop filter is known e.g. from J. D. Rhodes, Waveguide Bandstop Elliptic Function Filters, IEEE Trans. on Microwave Theory and Techniques volume MTT-20, No. 11, November 1972, pages 715-718.

In this known filter, along a wall of the waveguide extending in a straight line, there are several resonator chambers which couple to the hollow waveguide by diaphragms in the wall. The characteristic of this filter is determined by the resonance frequencies of the chambers, the distance of the chambers from each other along the waveguide and the strength of its coupling to the waveguide. This latter again depends from the free cross section area of the diaphragm. It is easily understood that the coupling is the stronger, the larger the free cross section area of the diaphragm is. An upper limit of the coupling strength is therefore defined by the fact that the free cross section of the diaphragm cannot become greater than that of the chamber coupling to the hollow waveguide via the diaphragm.

The object of the invention is to provide a novel construction principle for a bandstop filter by which stronger couplings can be realized than by the conventional construction principle.

This object is achieved by a bandstop filter of the type indicated at the beginning, in which in the waveguide there is located at least one resonator body having a resonance frequency above the limit frequency of the waveguide.

Waveguide bandpass filters which have pins made of an electrically conductive material arranged in a waveguide which interconnects input and output ports are known as so called combine filters. In contrast to the present invention, these are waveguides, the limit frequency of which is above the working band frequency (transmission band), i.e. the resonance frequencies of the resonator bodies are below the limit frequency of the waveguide channel and at the frequency of the desired pass band. Outside the useful transmission band, a blocking effect is achieved mainly by the so called cut off effect of the waveguide.

According to the desired order of the bandstop filter, several resonator bodies may be provided; it is also possible to replace one or more of the several resonator bodies by laterally located resonator chambers of the type known from the prior art. The resonator body is preferably formed as a pin protruding from a first wall of the waveguide. This pin may be additionally inserted into the waveguide; preferably, it is formed in one piece with the first wall in order to achieve a minimum junction resistance between the resonator body and the first wall.

Under manufacturing aspects, it is advantageous if the waveguide has a rectangular cross section with broad and narrow sides, and the resonator body protrudes from one of the broad sides.

Further, it is preferred that there is an inductive or capacitive discontinuity located in the waveguide, especially in case of a filter of second or higher order, in order to provide face coupling between the resonators and to achieve in this way a reflexion characteristic of the filter which has zeros at finite frequencies. I.e. such a bandstop filter has, in addition to a stop band, a working band in the vicinity of reflexion zeros of finite frequency. Filters of this type are useful e.g. for applications in which a microwave transmission line is operated in frequency duplex and it is necessary, at each side of the transmission line, to feed the transmission frequency of the other side to a receiver with as little attenuation as possible, whereas at the same time, the transmission frequency of the same side has to be kept away from the receiver as completely as possible.

The discontinuity preferably is an iris diaphragm.

The iris diaphragm can preferably be formed by a web which protrudes from one of the sides of the waveguide. Preferably, two webs are provided which protrude from opposite sides and face each other at a same level.

A diaphragm formed by webs which protrude from narrow sides of the waveguide and face each other is advantageous to manufacture, in particular by machining.

According to a first embodiment, the waveguide has planar walls near the resonator body. The strength of the coupling of such a resonator body is determined in particular by its distance from a neighbouring wall.

In order to achieve a desired coupling, it may be appropriate if the waveguide has a recess near the resonator body.

In the case of a waveguide of rectangular cross section having first to third walls which are planar near the resonator body and a fourth wall in which the recess is formed, the resonator body is preferably located at a side facing the fourth wall of an imaginary centre plane which extends between said fourth wall and a second wall facing it; in particular, the resonator body may be partially or completely engaged in the recess.

Since the coupling strength may be determined by appropriately placing the resonator body, the recess may be kept free from undercuts which might function as a diaphragm.

In particular if a recess as explained above is formed in the second wall, but also for other reasons, the second wall may have at least one curved portion. In this case, the distance of the resonator body from each wall, in a cross section parallel to the first wall from which the resonator body protrudes, is at least as large as the smallest curvature radius of the second wall, preferably twice as large as the latter. The smallest radius of curvature of the second wall gives an upper limit for the diameter of a machining head by which the hollow waveguide may be machined from a workpiece. This machining head diameter also determines the smallest realisable distance between the resonator body and the walls in this cross section.

Further features and advantages of the invention become apparent from the description of embodiments referring to the appended figures.

Figure 1:
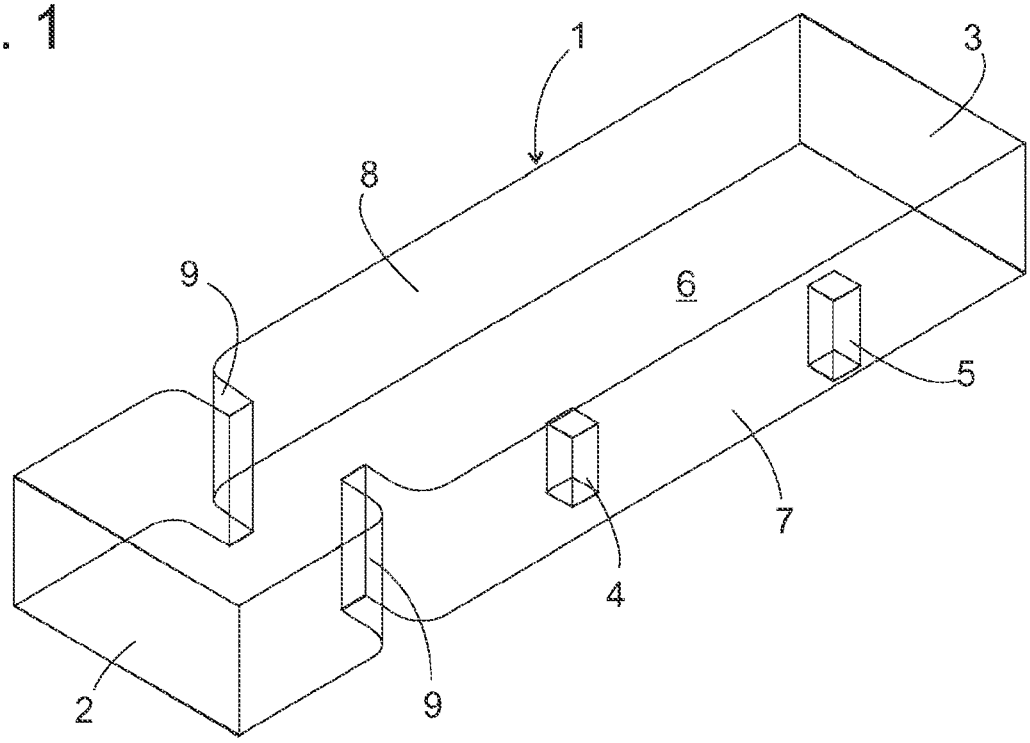
FIG. 1 is a schematic perspective view of a second order bandstop filter according to the invention.
Figure 6:
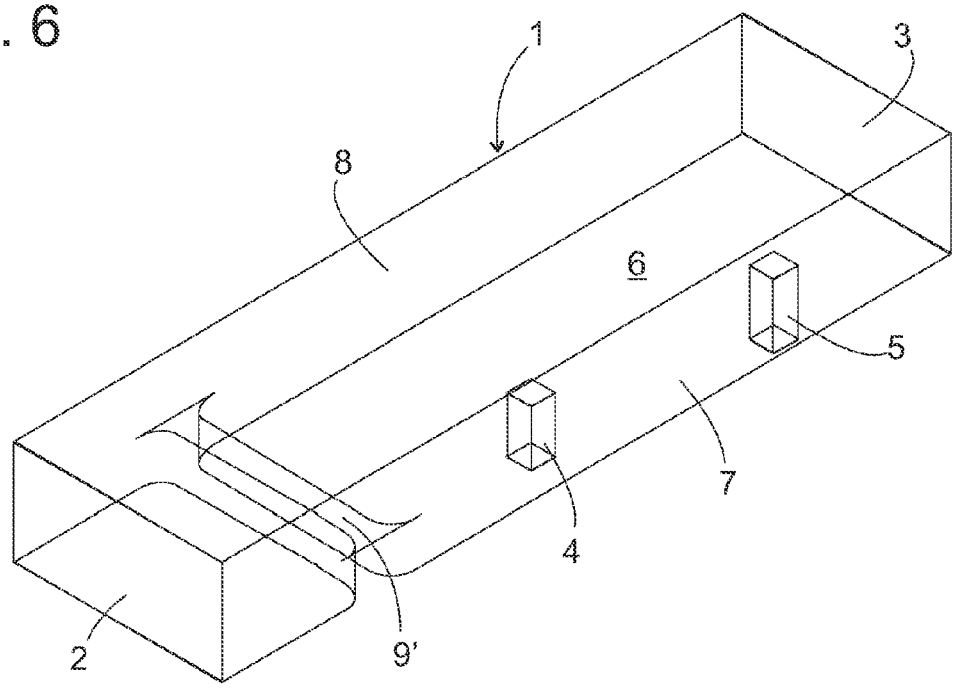
Figure 7:
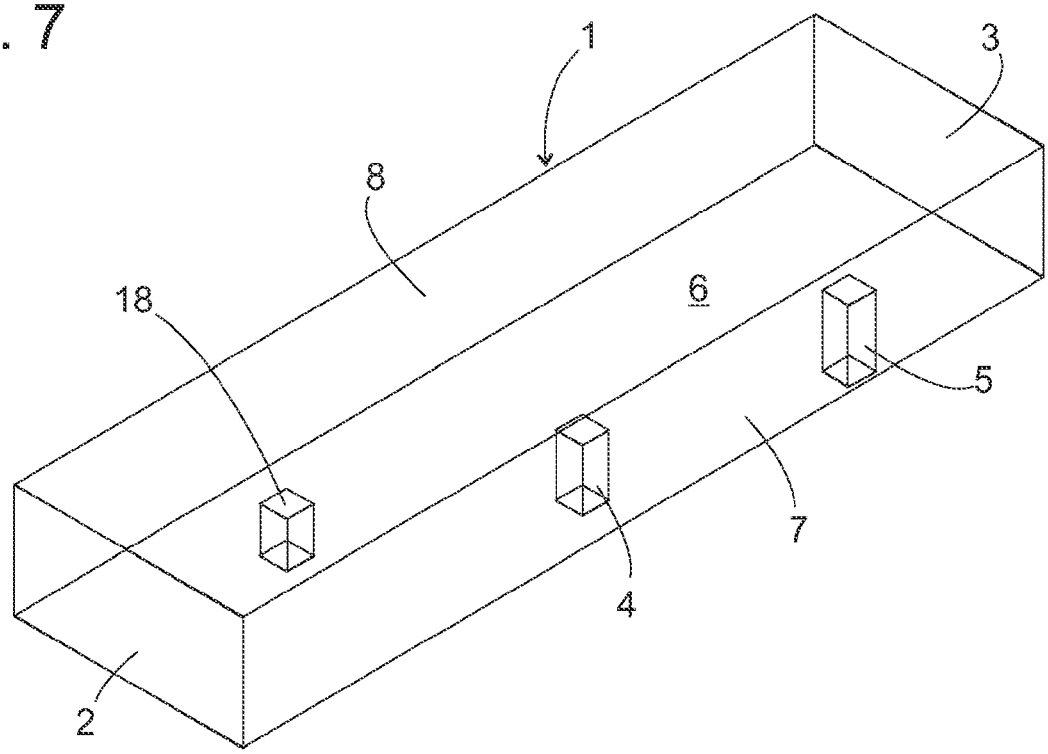

FIGS. 6 and 7 each illustrate a modified embodiment of the filter of FIG. 1.

The bandstop filter shown in FIG. 1 is essentially formed of a waveguide portion 1 having a flat rectangular cross section and extending essentially in a straight line between input and output ports 2, 3. Two resonator bodies 4, 5 protrude from a bottom wall 6 of the hollow waveguide portion into its interior. The resonator bodies 4, 5 each have a resonance frequency above the limit frequency or cutoff frequency of the waveguide portion 1. The resonator bodies 4, 5 are massive metal bodies or are at least superficially metallized, wherein the metal of the resonator bodies 4, 5 is electrically connected to the metal bottom wall 6. The resonator bodies form so-called λ/4-resonators.

A massive metallic resonator body 4 or 5 may be formed in one piece with the bottom wall 6, in particular if the waveguide portion is formed by material ablation from a massive metal block. It is also possible, however, to insert a resonator body into the waveguide portion 1 afterwards, e.g. by soldering. This may become necessary if, as in case of resonator body 5, the distance from the resonator body to the closest adjacent side wall 7 is too narrow for an ablation tool to engage in between.

The distance of the resonator bodies 4, 5 in the side walls defines the coupling of these to a RF field propagating in the waveguide portion 1. This coupling is maximum for a resonator body located in a longitudinal centre plane extending between the two side walls 7, 8 of the waveguide portion 1 and decreases as the resonator body approaches one of the side walls 7, 8.

The distance of the resonator bodies 4, 5 from each other in the longitudinal direction of the waveguide portion 1 is typically 3λ/4, λ being the wavelength at the centre frequency of the stop frequency band of the filter. The corresponding distances between the resonators result from the desired filter characteristic and arrangement, i.e. from the phase lengths between the resonators and the discontinuity determined in a corresponding synthesis.

In the sidewalls 7, 8, webs 9 are formed which face each other at a same level, which extend across the entire height of the side walls and protrude inside the waveguide portion 1. These webs form a diaphragm which couples to the resonator bodies 4, 5. By the diaphragm, it can be achieved that zeros of reflexion of the filter which would otherwise be located at a frequency f=∞ are displaced to finite frequencies. In this way, a filter characteristic as shown in FIG. 2 can be obtained.

Figure 2:
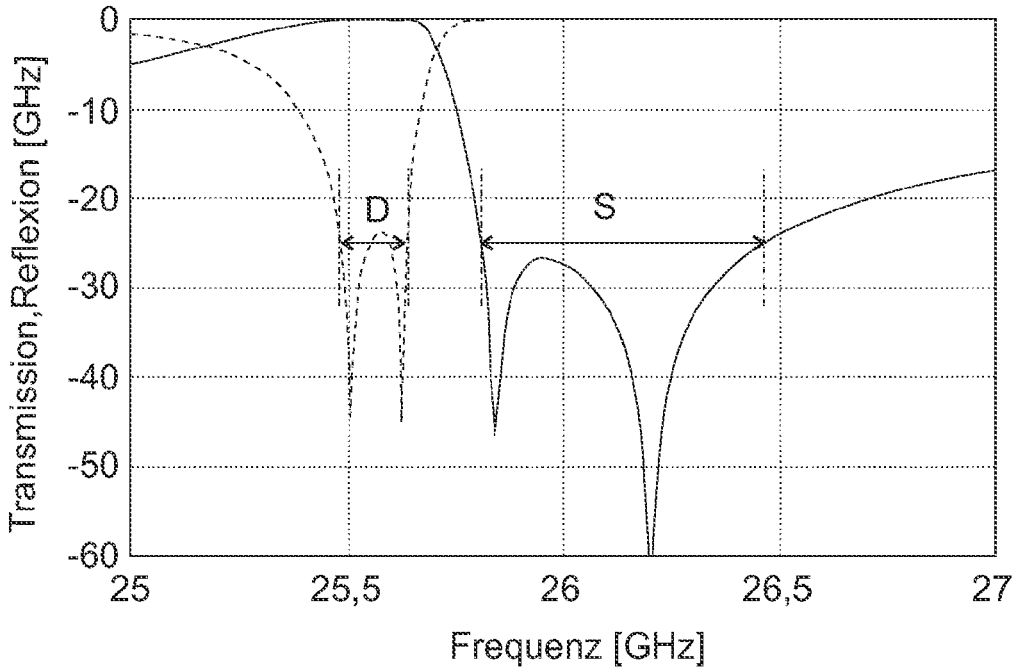
FIG. 2 illustrates exemplary reflexion and transmission curves of a filter having the design shown in FIG. 1.

FIG. 2 shows reflexion and transmission curves, obtained by a simulation calculation, of a filter having the design shown in FIG. 1, with two resonator bodies and a diaphragm. The transmission characteristic is represented as a solid line, the reflexion characteristic as a dashed line. A stop band S extends from approximately 25.8 MHz to 26.45 MHz and has poles (transmission zeros) caused by resonator bodies 4, 5 at approximately 25.85 GHz and 26.2 GHz.

By means of the diaphragm, all zeros of reflexion may be positioned at defined frequencies: in this way a maximum flexibility for obtaining arbitrary filter characteristics is achieved. For the embodiment of FIG. 1, a transmission band D having two reflexion zeros may be formed close to the blocking regions at 25.5 and 25.65 GHz. Such a bandstop filter having an asymmetric characteristic can be used to advantage for placing it upstream of a receiver in a microwave transmitter/receiver unit having a transmitter transmitting in the stop band, in order to protect the receiver from the signal of the transmitter of this unit, and to enable unattenuated reception of a signal originating from a remote transmitter in the transmission band.

Figure 3:
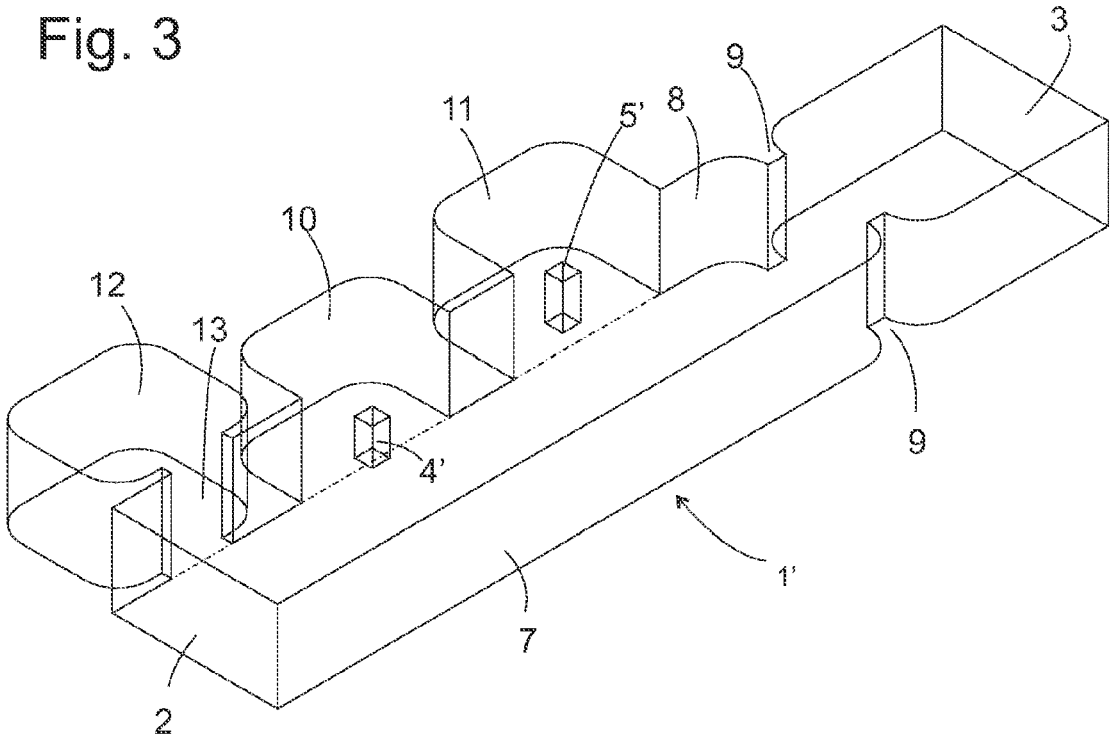
FIG. 3 is a perspective view of a third order bandstop filter according to the invention.

FIG. 3 shows illustrates a third order bandstop filter in a perspective view analogous to FIG. 1, according to a second embodiment of the invention. As in case of FIG. 1, a waveguide portion 1' extends essentially in a straight line between ports 2, 3 and is provided with metallic resonator bodies 4', 5'. A dash-dot alignment line of a side wall 8 extends across resonator body 4', the second resonator body 5' is located slightly beyond this alignment line. Around the resonator bodies 4', 5', recesses 10, 11 are formed in the side wall 8'. A third resonator is formed by a cavity 12, which is coupled to the waveguide portion 1 by a diaphragm 13. If desired, the cavity 12 might also be replaced by a resonator body located in a recess, or one of the resonator bodies 4', 5', in particular the resonator body 5', which is rather weakly coupled due to its large distance from the centre plane of the waveguide portion 1, might eventually be replaced by a further cavity.

The resonance frequency of a resonator body located in a recess may differ from that of a resonator body of identical dimensions located in the waveguide portion 1' itself. The resonance frequency required for the filter characteristic is defined by the resonator body in conjunction with the recess. The function of the recesses 10, 11 is twofold. On the one hand, the presence of the recess reduces the dependence of the coupling strength of a resonator body located near the recess on its distance from the centre plane, so that the manufacture-dependent scatter of the coupling strength is reduced. On the other hand, the large distance between the resonator bodies 4', 5' and the walls of the recesses 10, 11 surrounding them allows to form even rather weakly coupled resonator bodies in one piece with the bottom wall of the waveguide portion, whereby a scatter in the filter behaviour caused by varying quality of an electric through connection subsequently created between the bottom wall and the inserted resonator body is avoided.

Figure 5:
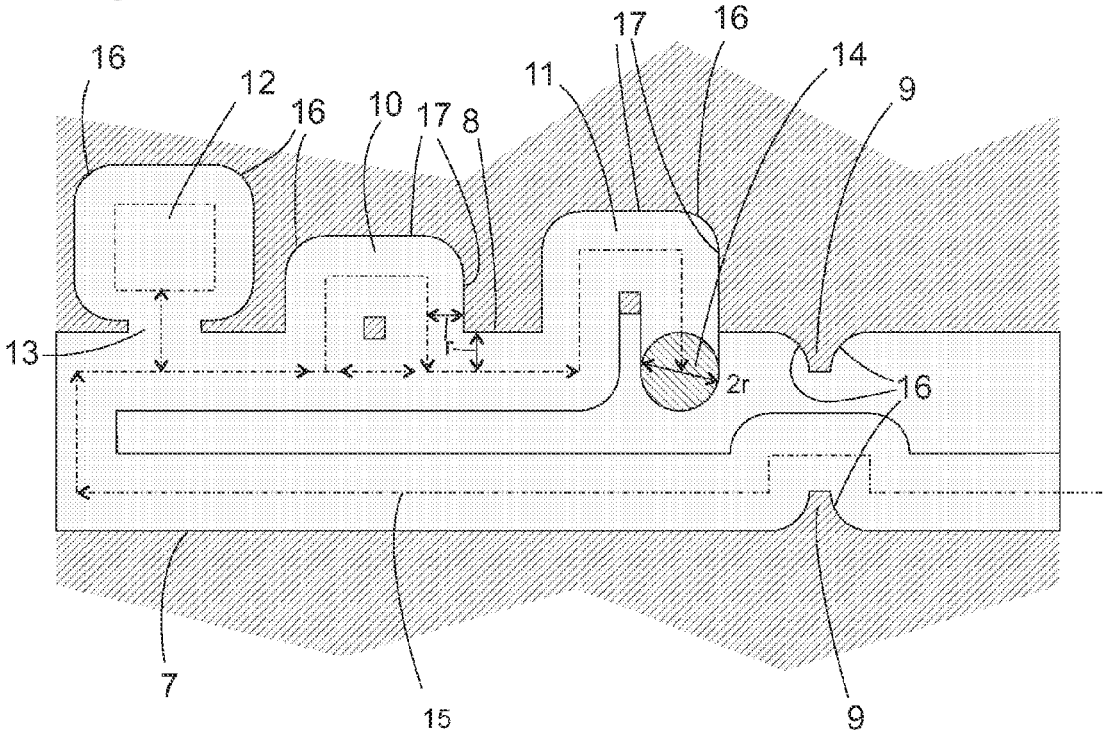
FIG. 5 is a top view of the filter of FIG. 3 during its manufacture.

FIG. 5 illustrates this fact by means of a top view of the filter of FIG. 3 in a partly finished state. A machining head, by which material is removed by layers in order to form the waveguide portion 1, is referred to by 14. A dash-dot line 15 designates the path of machining head 14. Curvature radii at the corners 16 of the cavity 12, the recesses 10, 11 and at the base of the webs 9 are the same as the radius r of machining head 14, so that for forming the side walls the machining head has to be moved either only in the longitudinal direction of the waveguide portion 1 or in a transverse direction thereto. The distance between the lateral sides 17 of the resonator bodies 4', 5' of rectangular cross section and the side walls 18 of recesses 10, 11 facing them is the same as the diameter of machining head 14, so that it is sufficient to move the machining head 14 once around the resonator bodies 4', 5' in order to generate the shape of recesses 10, 11.

Figure 4:
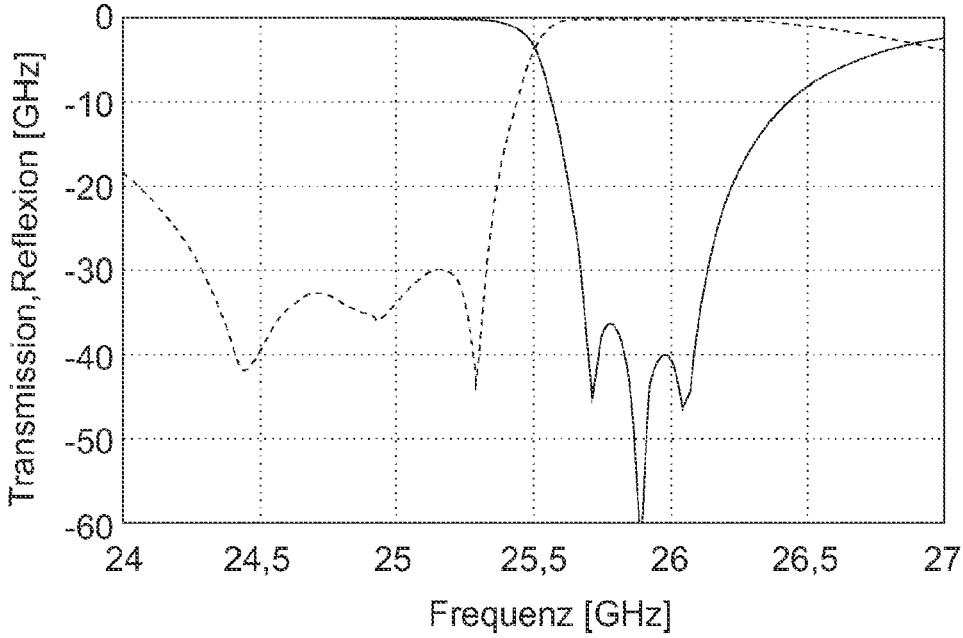
FIG. 4 illustrates reflexion and transmission of a filter having the design shown in FIG. 3.

The characteristic of the bandstop filter of the type of FIG. 3 is shown in FIG. 4. Again, a dashed line illustrates the reflexion characteristic, and a solid line illustrates the transmission characteristic. Corresponding to the three resonators 4', 5', 11 the curves have three zeros each, and just as in case of FIG. 2, a stop band S and a transmission band D are formed in close vicinity.

FIG. 6 illustrates a first modification of the filter of FIG. 1. Instead of the two webs 9 symmetrically facing each other, a discontinuity is formed here by a single web 9' protruding from the bottom wall 6.

In a second modification shown in FIG. 7, the discontinuity is formed by a single pole 18 which, like the resonator bodies 4, 5 is metallic or metallized and which differs from the latter mainly by its length. It may extend between two walls 6, 19 of the waveguide, or it may be substantially shorter than the resonator bodies 4, 5, so that an eventual resonance frequency of the pole 18 is clearly above or below the operation frequency range of the filter.

In the embodiments described above, a bottom wall from which the resonator bodies protrude is the broad side of rectangular cross section. Of course, in all these examples, also a narrow side might be contemplated as support for the resonator bodies.

Certainly, tuning means such as screws, dielectrics, etc., which, being known as such, are not specifically represented, may be provided at the resonator bodies and/or the discontinuity for finetuning size, placement or the like.

The invention claimed is:

1. A bandstop filter comprising:

an input port;

an output port; and a waveguide connecting the input and output ports;

at least one resonator body located within the waveguide interior, and having a resonance frequency above a limit frequency of the waveguide, the resonator body comprising a pin protruding from a first wall of the waveguide; and in a cross-section of the waveguide parallel to the first wall, a second wall having at least one curved portion, and wherein a distance of the resonator body from each wall in the cross-section is greater than or equal to the smallest radius of curvature of the second wall.

2. The bandstop filter of claim 1 wherein the resonator body is formed as a unitary structure integral with the first wall.

3. The bandstop filter of claim 1 wherein the waveguide comprises a rectangular cross section having broad sides and narrow sides, and wherein the resonator body protrudes from one of the broad sides.

4. The bandstop filter of claim 1 further comprising a discontinuity member located within the waveguide, the discontinuity member comprising one of an inductive discontinuity member and a capacitive discontinuity member.

5. The bandstop filter of claim 4 wherein the discontinuity member comprises an iris diaphragm.

6. The bandstop filter of claim 5 wherein the iris diaphragm is formed by at least one web protruding from a side of the waveguide.

7. The bandstop filter of claim 6 wherein the waveguide comprises a rectangular cross section having broad sides and narrow sides, and wherein the resonator body protrudes from one of the broad sides, and the iris diaphragm is formed by opposite webs protruding from the narrow sides.

8. The bandstop filter of claim 1 wherein the waveguide comprises planar walls near the resonator body.

9. The bandstop filter of claim 1 wherein the waveguide comprises a substantially hollow waveguide having a recess near the resonator body.

10. The bandstop filter of claim 9 wherein the waveguide has a rectangular cross section comprising first, second, and third planar sidewalls disposed proximate the resonator body, and a fourth sidewall in which the recess is formed.

11. The bandstop filter of claim 10 wherein the second and fourth sidewalls oppose each other, and wherein the resonator body is located at a side of a center plane that faces the fourth sidewall and extends between the second and fourth sidewalls.

12. The bandstop filter of claim 9 wherein the recess is free from undercuts.

* * * * *